US007055836B2

(12) United States Patent
Cheng

(10) Patent No.: US 7,055,836 B2
(45) Date of Patent: Jun. 6, 2006

(54) IMMOBILIZING MECHANISM OF A BABY-WALKER

(76) Inventor: Fei-Da Cheng, No. 141, Dawan 3rd St., Yongkang City, Tainan County (TW)

( * ) Notice: Subject to any disclaimer, the term of this patent is extended or adjusted under 35 U.S.C. 154(b) by 117 days.

(21) Appl. No.: 10/852,201

(22) Filed: May 25, 2004

(65) Prior Publication Data

US 2005/0082779 A1 Apr. 21, 2005

(30) Foreign Application Priority Data

Oct. 21, 2003 (TW) ..... 92129091 A

(51) Int. Cl.
*B62B 9/08* (2006.01)

(52) U.S. Cl. ..... 280/87.051; 280/658; 297/5; 188/20

(58) Field of Classification Search ..... 280/87.01, 280/87.021, 87.041, 87.051, 657, 658, 47.38, 280/30, 31, 32; 297/5, 6; 188/5, 20
See application file for complete search history.

(56) References Cited

U.S. PATENT DOCUMENTS 4,799,700 A * 1/1989 Knoedler et al. ..... 280/87.051
4,822,030 A * 4/1989 Cone ..... 280/87.051
5,366,231 A * 11/1994 Hung ..... 280/87.051
5,586,622 A * 12/1996 Hu ..... 188/20
5,590,892 A * 1/1997 Hu ..... 280/87.051
5,727,800 A * 3/1998 Liu ..... 280/87.051
5,938,218 A * 8/1999 Chuang ..... 280/87.051
6,224,077 B1 * 5/2001 Sheng ..... 280/87.051
6,352,234 B1 * 3/2002 Liu ..... 248/677

* cited by examiner

*Primary Examiner*—Christopher P. Ellis
*Assistant Examiner*—Brian Swenson
(74) *Attorney, Agent, or Firm*—Rosenberg, Klein & Lee

(57) ABSTRACT

An immobilizing mechanism of a baby-walker includes an upper part up and down movably fitted to a lower frame of the walker, a base connected to a lower portion of the upper part in an up and down displaceable manner, and a button fitted on the lower frame; the upper part is biased upwards by several springs, and has a resilient portion, which can engage the lower frame to prevent the upper part from moving up after the upper part is depressed; a spring is arranged between the upper part and the base such that a lower end of the base is normally farthest away from the upper part; the button is used for disengaging the resilient portion from the lower frame; thus, the mechanism can be made to support the baby-walker instead of the wheels by depressing the upper part, and can become inactive when the button is pressed.

5 Claims, 12 Drawing Sheets

IMMOBILIZING MECHANISM OF A BABY-WALKER

BACKGROUND OF THE INVENTION

1. Field of the Invention

The present invention relates to an immobilizing mechanism of a baby-walker, more particularly one, which can be easily moved between an immobilizing position and an inactive position.

2. Brief Description of the Prior Art

Referring to FIGS. 11 and 12, a conventional baby-walker 3 includes an upper frame part 31, a lower frame part 32, two pairs of support rods 22, and is equipped with an immobilizing mechanism 35 on the lower frame part 32; each pairs of support rods 33 are pivoted to each other substantially at middle portions thereof, and pivoted to the upper frame part 31 at upper ends thereof. And, two of the support rods 33 are pivoted to rear portions of the lower frame part 32 at lower ends thereof, and the other two support rods 33 are movably fitted on front portions of the lower frame part 32 at lower ends thereof.

The immobilizing mechanism 35 includes an upper rod part 351, a contact base 352, a pin 353, and a spring 355. The upper rod part 351 is up and down movably fitted to a vertical holding hole of the lower frame part 32, and biased upwards with the spring 355. The lower frame part 32 has two vertical guide spaces 354 adjacent to a lower portion of the holding hole and exactly facing other. The contact base 352 is joined to the lower end of the upper rod part 351 with a lower end thereof projecting beyond from a bottom side of the lower frame part 32; the contact base 352 will be a distance above the ground after the upper rod part 351 is biased to an upper position. The pin 353 is connected to a radial through hole of the upper rod part 351 with two ends thereof projecting out from the upper rod part 351 such that the two ends thereof will be in upper ends of the guide spaces 354 of the lower frame part 32 when the upper rod part 351 is in the upper position, as shown in FIG. 13.

Thus, the contact base 352 will project beyond wheels of the baby-walker, and the baby-walker can be supported on the contact base 352 with the wheels being off the ground after the upper rod part 351 is depressed, and turned such that the pin 353 moves outside the guide spaces 354, and is stopped from moving up by a bottom side of the lower frame part 32. And, the upper rod part 351 and the contact base 352 will be in their respective upper positions after the upper rod part 351 is turned such that the pin 353 faces the guide spaces 354, and released.

Although the immobilizing mechanism 35 can be used to immobilize the baby-walker, it has disadvantages as followings:

1. While depressing the upper rod part 351 towards the lower position, the user has to lift the baby-walker otherwise the contact base 352 will be stopped by the ground, and can't project beyond the wheels. Furthermore, after having moved the same to the lower position, the user has to turn the upper rod part 351 such that the pin 353 is stopped under the bottom side of the lower frame part 2. Therefore, to make the immobilizing mechanism function, the user not only has to depress the upper rod part 351, but he also has to lift the baby-walker and turn the upper rod part 351. In other words, the immobilizing mechanism isn't convenient to use.
2. To make the immobilizing mechanism inactive, the user has to first lift the baby-walker otherwise the pin 353 is tightly pressed against the bottom side of the lower frame part 2, and it is difficult to turn the upper rod part 351. And, the user has to turn the upper rod part 351 such that two ends of the pin 353 face the guide spaces 354 exactly otherwise the pin 353 will be stopped under the bottom side of the lower frame part 2. Therefore, the immobilizing mechanism isn't convenient to use.

SUMMARY OF THE INVENTION

It is a main object of the present invention to provide an immobilizing mechanism of a baby-walker to overcome the above disadvantages.

The present mechanism includes an upper part up and down movably fitted to a lower frame of the walker, a base connected to a lower portion of the upper part in an up and down displaceable and limited manner, and a button fitted on the lower frame. The upper part is biased upwards by several springs, and has a resilient portion, which can engage the lower frame to prevent the upper part from moving up after the upper part is depressed. Another spring is arranged between the upper part and the base such that a lower end of the base is normally farthest away from the upper part. The button is used for disengaging the resilient portion from the lower frame. Thus the mechanism can be made to support the baby-walker instead of the wheels by depressing the upper part, and can become inactive when the button is pressed.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
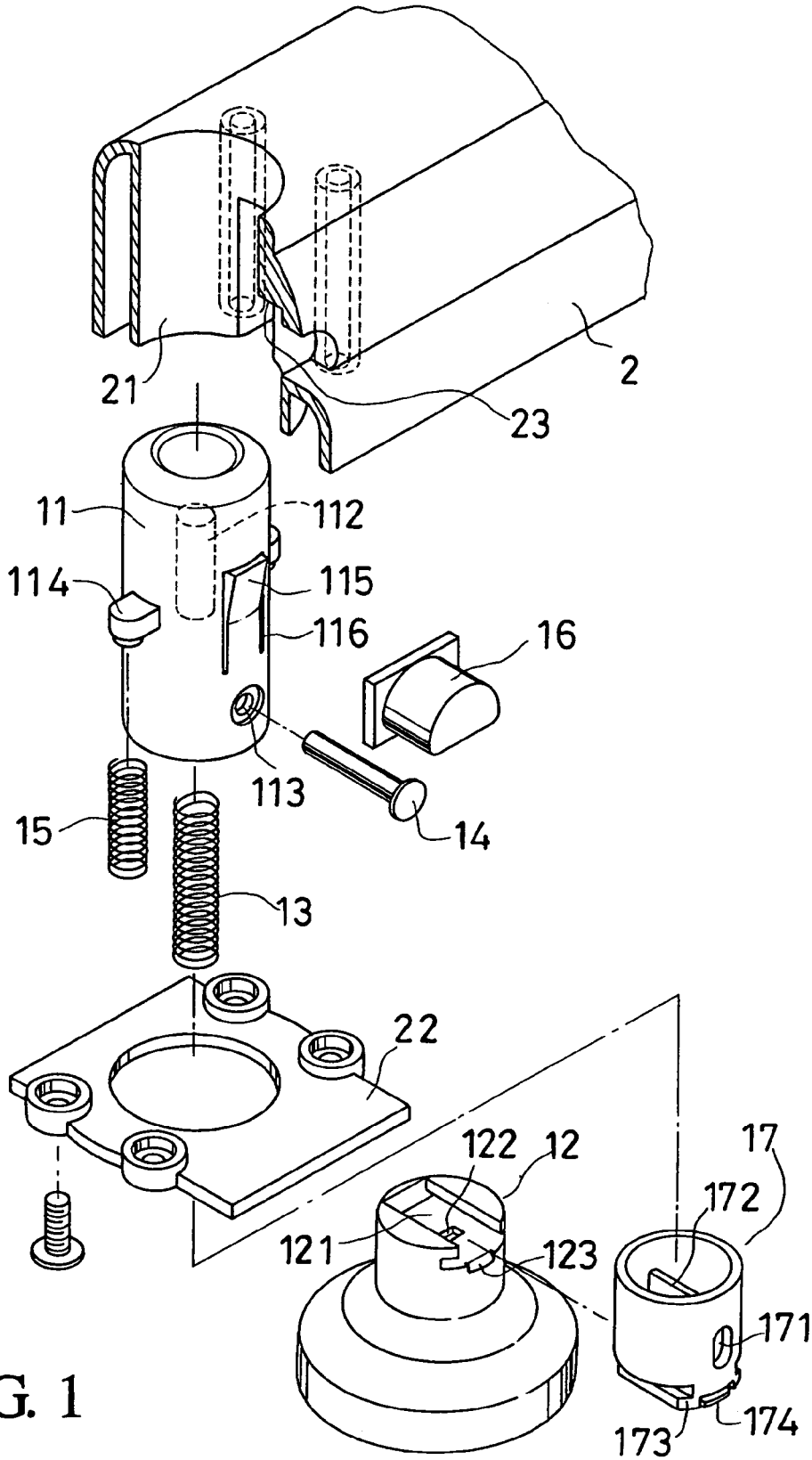
FIG. 1 is an exploded perspective view of the immobilizing mechanism of a baby-walker according to the present invention.
Figure 2:
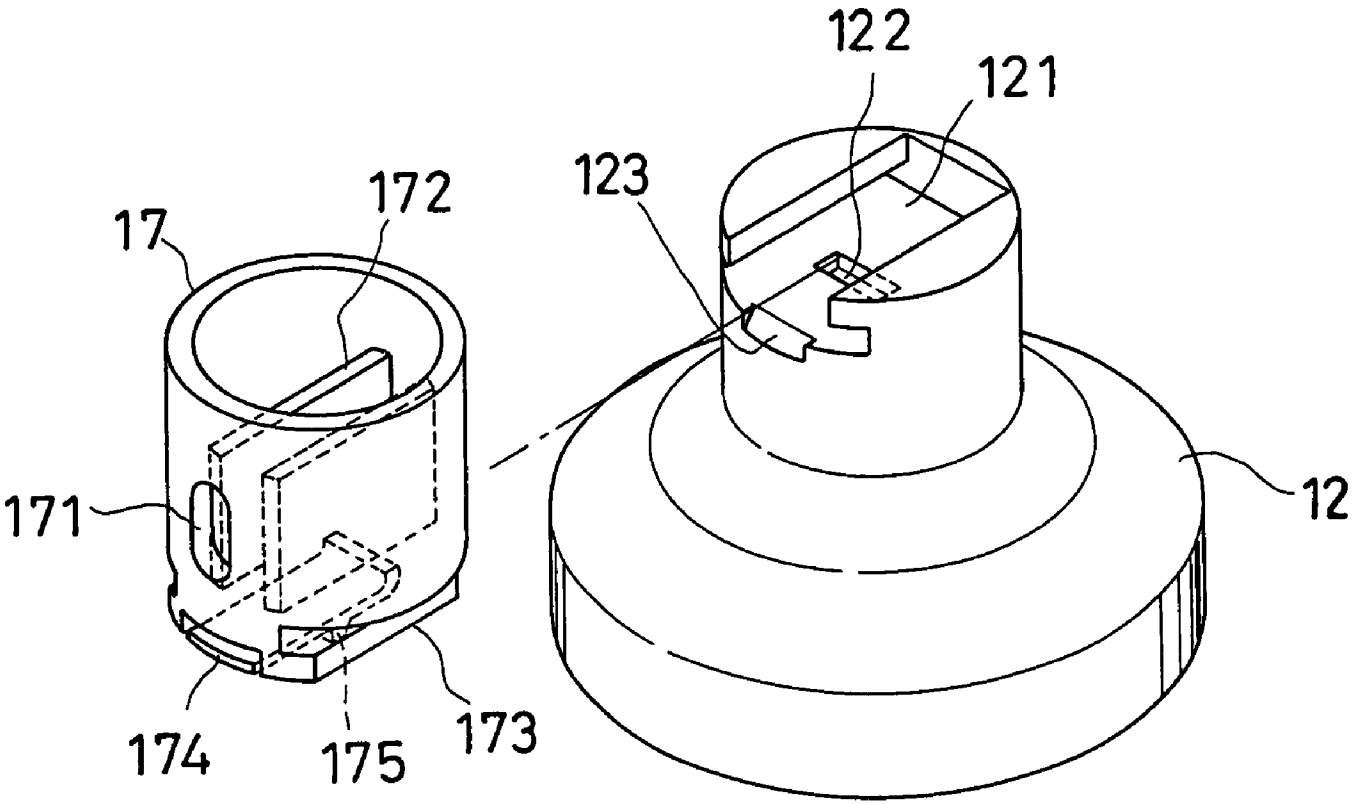
FIG. 2 is a partial exploded perspective view of the immobilizing mechanism of a baby-walker in the present invention.
Figure 7:
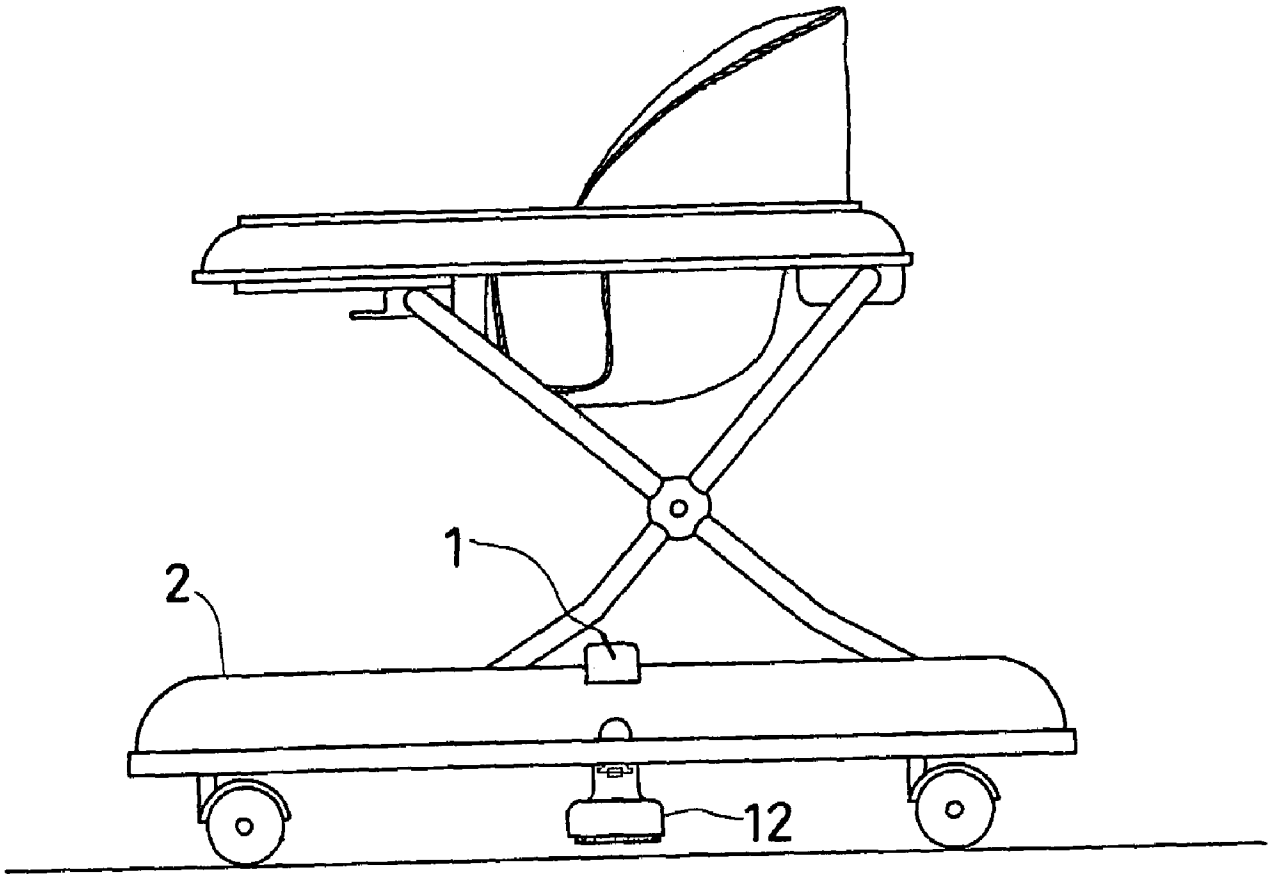
FIG. 7 is a side view of the baby-walker, with the immobilizing mechanism in the upper inactive position.

Referring to FIGS. 1 and 7, a preferred embodiment 1 of an immobilizing mechanism of a baby-walker includes an upper rod part 11, a base part 12, a first spring 13, two second springs 15, a button 16, and a connecting tube 17, and is fitted to one lateral portion of a lower frame part 2 of the baby-walker.

The lower frame part 2 has a holding room 21 extending from a top to a lower side thereof, a locating recess 23 adjacent to the holding room 21, and a through hole (not numbered) formed on an outward lateral side thereof and communicating with the locating recess 23. A supporting bottom board 22 is secured under the holding room 21 of the lower frame part 2.

The upper rod part 11 has a central room 111, a post 112 in the central room 111, two opposing through holes 113 on a lower end thereof, two locating protrusions 114 facing substantially opposite directions, and gaps 116 formed on an upright side of the upper rod part 11, which include a horizontal upper gap 116, and two substantially vertical lower ones 116 connected with two ends of the horizontal upper gap 116. Thus, a resilient engaging portion 115 is formed between the gaps 116, which engaging portion 115 is made to normally project outwards from the upright side of the upper rod part 11 at upper portion thereof.

The base part 12 has an inverted T-shaped fitting trench 121 on a top thereof, an engaging cavity 122, a cut 123 under, and communicating with an open end of the fitting trench 121. The base part 12 further has a slide prevention pad 124 secured on a bottom side thereof.

The connecting tube 17 has two opposing longitudinal slots 171 thereon, two parallel upright plates 172 therein, and an inverted T-shaped fitting portion 173 on a lower end thereof, which is formed with a resilient engaging plate 174 on a lower portion. In addition, the resilient engaging plate 174 has an engaging hook 175 projecting down from a lower side thereof.

Referring to FIGS. 3 to 6, the upper rod part 11 is positioned around the connecting tube 17 at the lower end, and connected with the connecting tube 17 by means of a connecting pin 14, which is passed through the slots 171, and the through holes 113. The spring 13 is positioned around the post 112 of the upper rod part 11 at an upper end, and supported on both the upright plates 172 of the connecting tube 17 at a lower end thereof such that the connecting tube 17 normally contacts the connecting pin 14 at upper ends of the slots 171 thereof. And, the connecting tube 17 is connected to the base part 12 with the inverted T-shaped engaging portion 173 being fitted in the inverted T-shaped engaging trench 121, and with the engaging hook 175 being fitted in the engaging cavity 122 to engage the base part 12.

In addition, the upper rod part 11 is up and down movably held in the holding room 21 of the lower frame part 2 with the resilient engaging portion 115 facing the locating recess 23; the springs 15 are fitted on the locating protrusions 114 of the upper rod part 11 at upper ends, and supported on the supporting bottom board 22 of the lower frame part 2 at lower ends thereof such that the upper rod part 11 is normally biased to an upper position by the springs 15. And, the button 16 is movably passed through the through hole of the lower frame part 2, which communicates with the locating recess 23, with an outer end thereof projecting out from the lower frame part 2.

Figure 3:
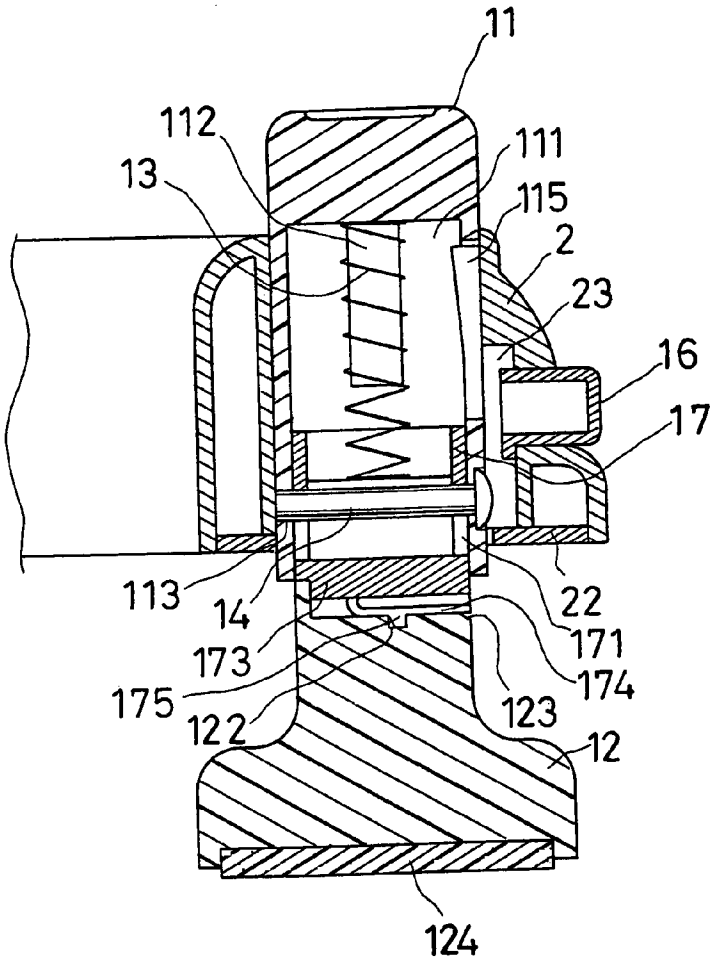
FIG. 3 is a vertical section of the immobilizing mechanism in the present invention.
Figure 10:
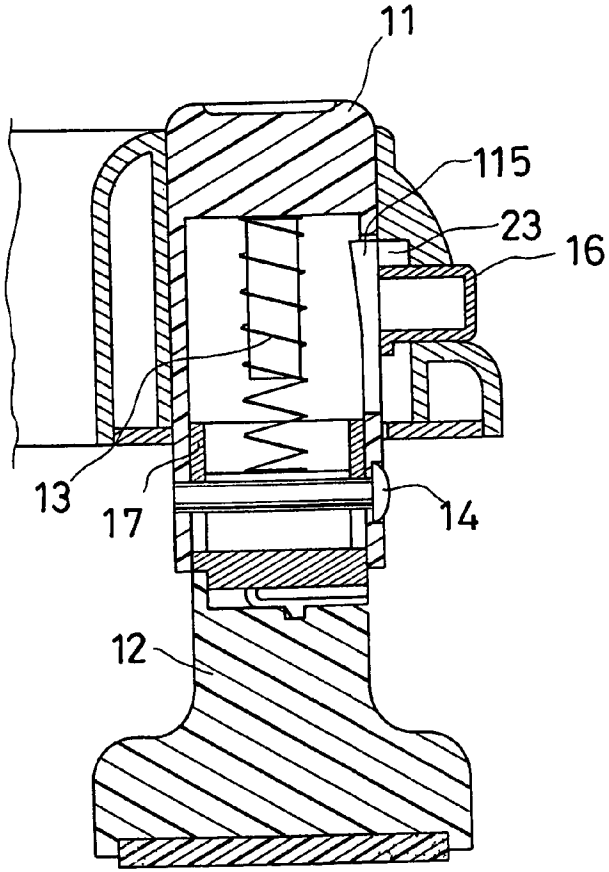
FIG. 10 is a vertical section of the present immobilizing mechanism, in a downward movement.
Figure 4:
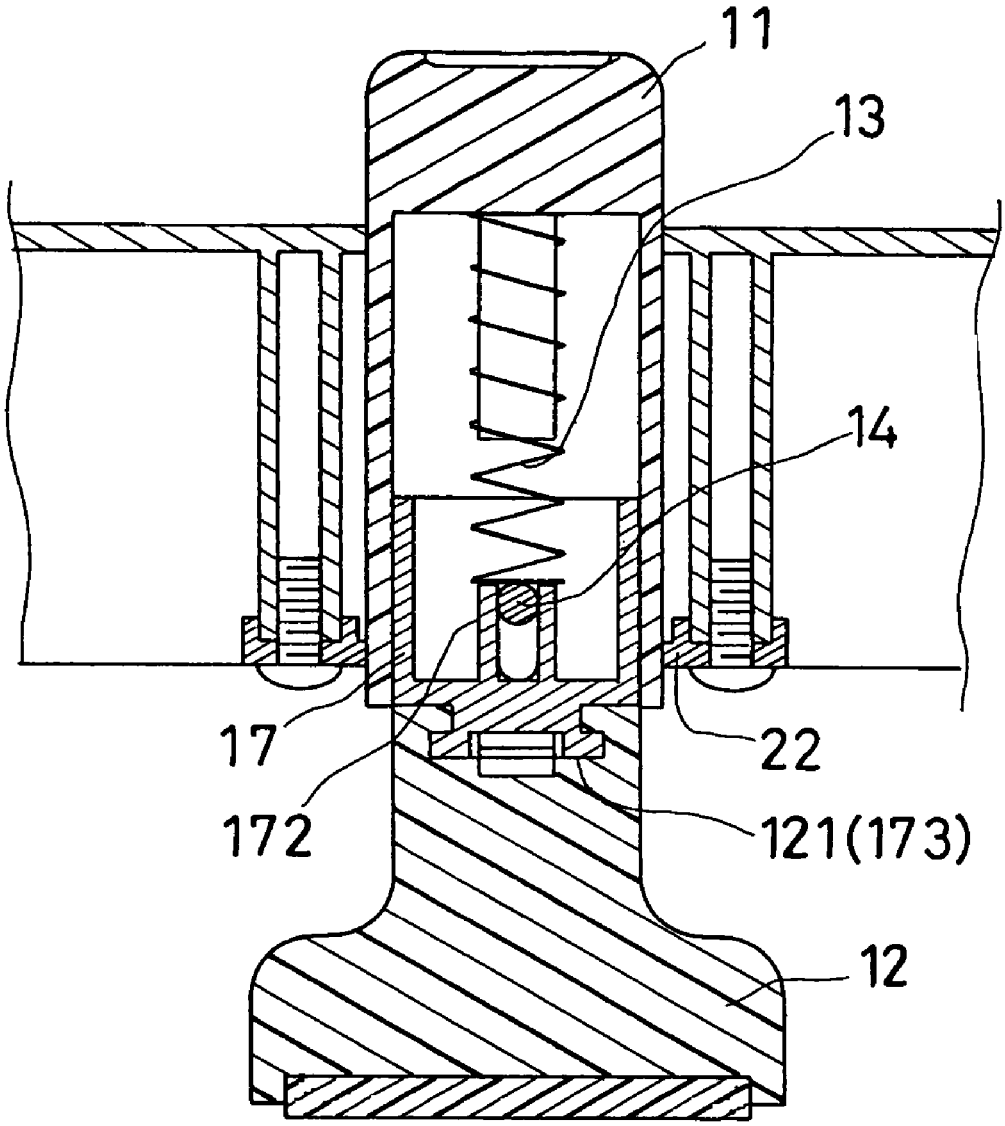
FIG. 4 is a second vertical section of the immobilizing mechanism.
Figure 5:
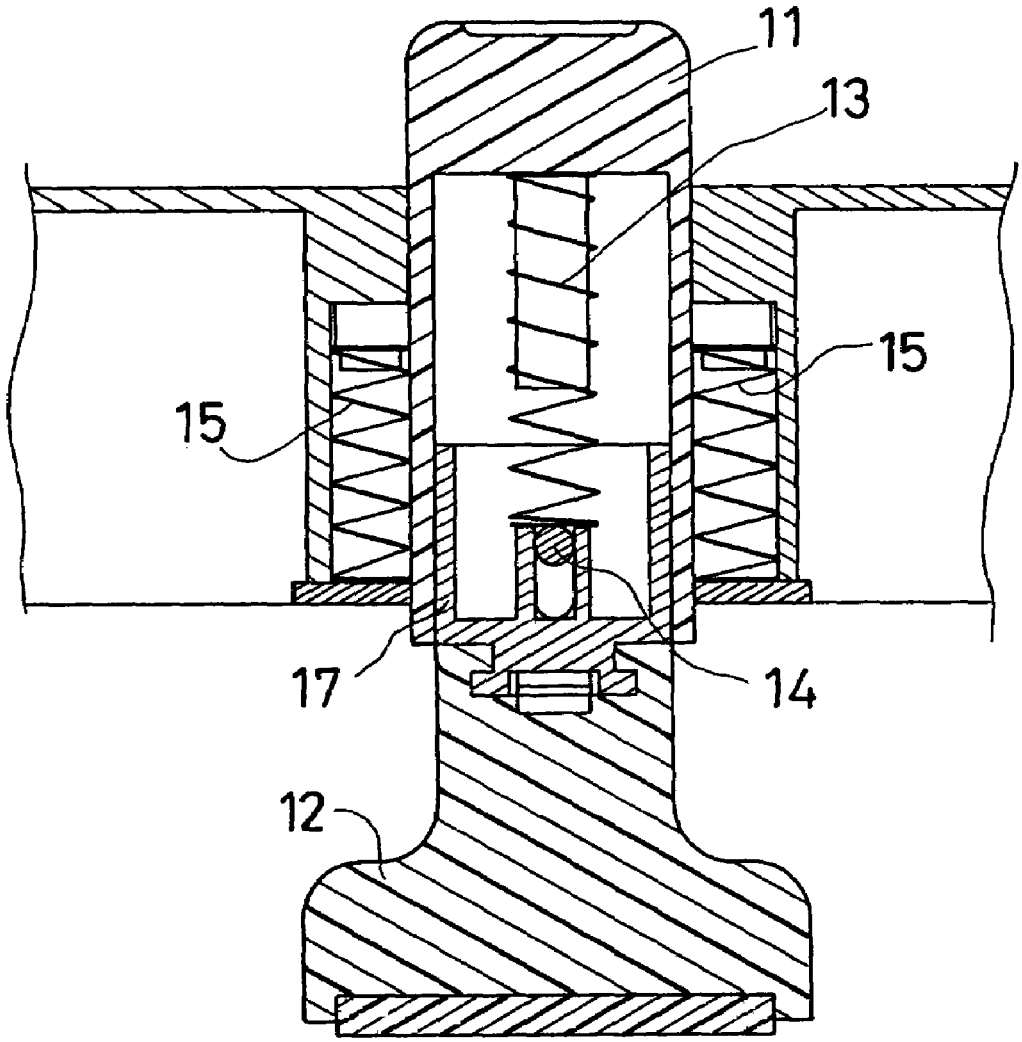
FIG. 5 is a third vertical section of the immobilizing mechanism.
Figure 6:
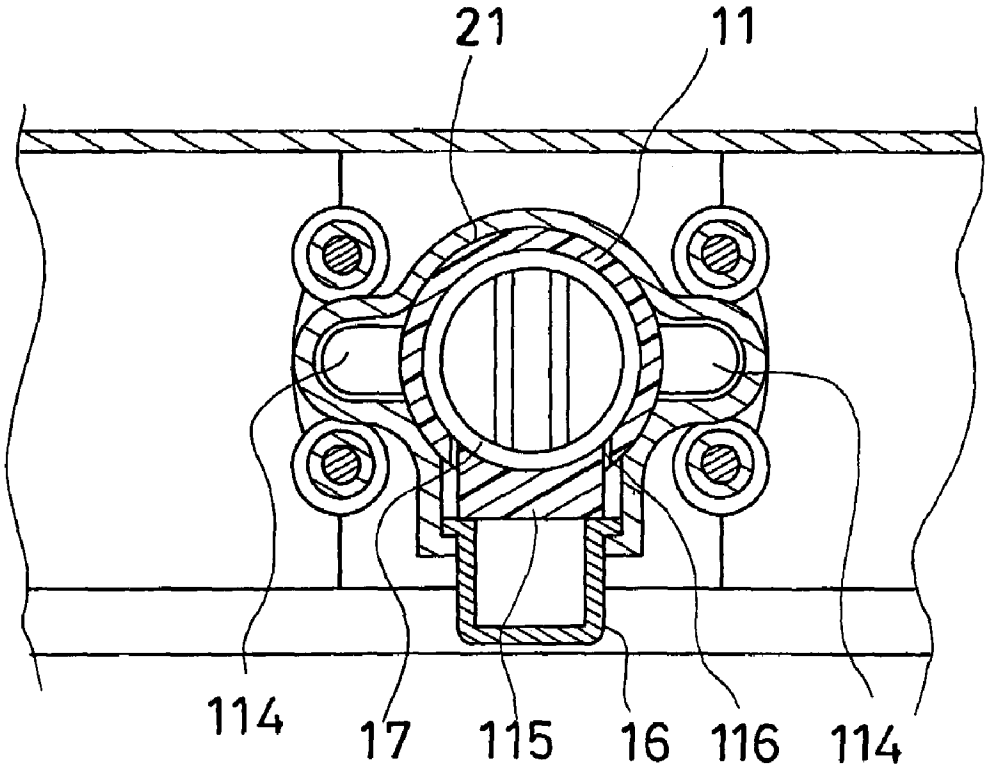
FIG. 6 is a horizontal section of the immobilizing mechanism of the present invention.

Referring to FIGS. 3 and 7, after the upper rod part 11 is made to move to an upper position by means of the springs 15, the immobilizing mechanism 1 will be in an inactive position where the slide prevention pad 124 of the base part 12 is off the ground. In addition, when the upper rod part 11 is in the upper position, the outwards projected upper portion of the resilient engaging portion 115 thereof will be in the holding room 21 of the lower frame part 2, and higher than the locating recess 23.

Figure 8:
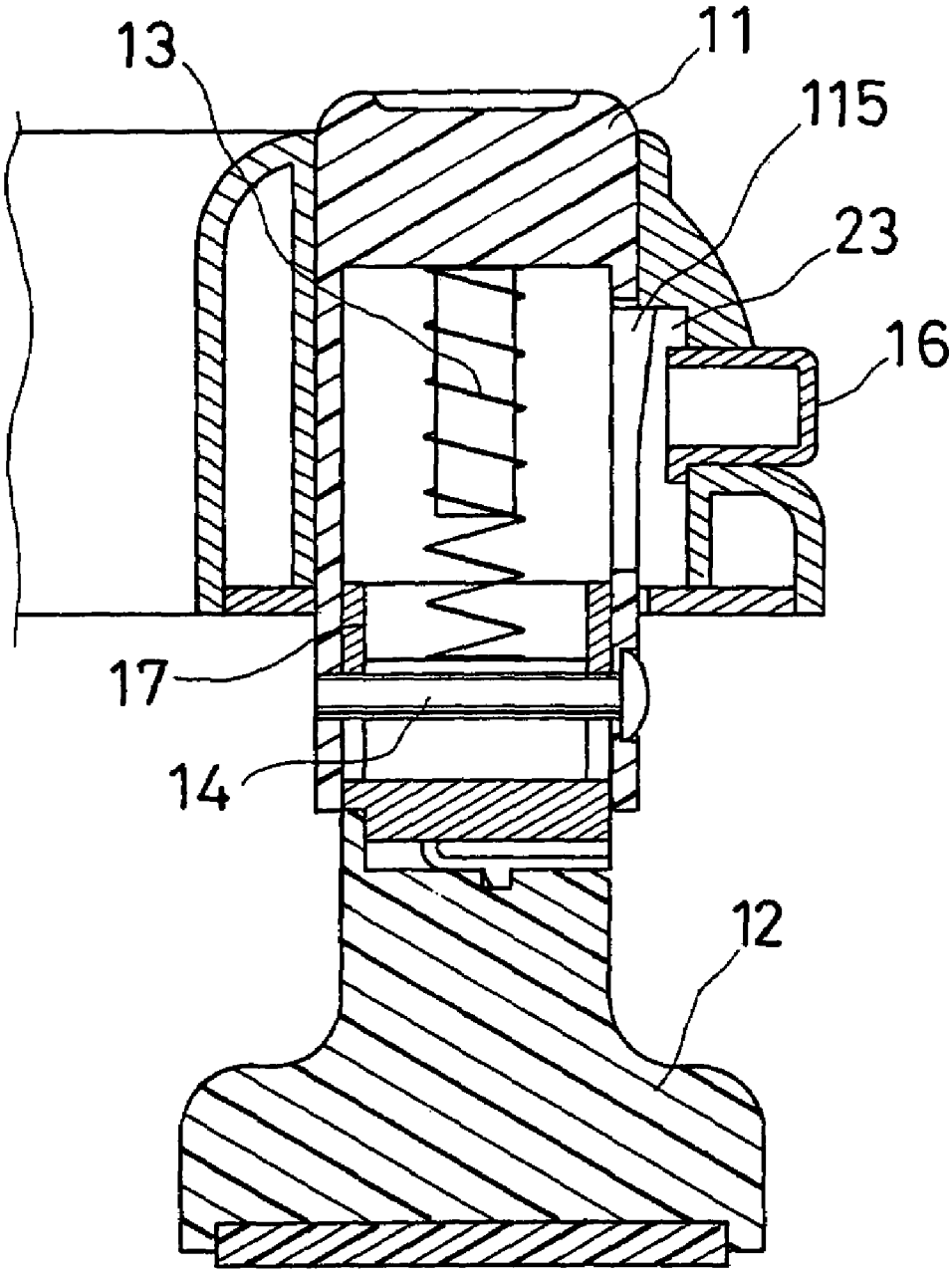
FIG. 8 is a vertical section of the present immobilizing mechanism, in the lower immobilizing position.
Figure 9:
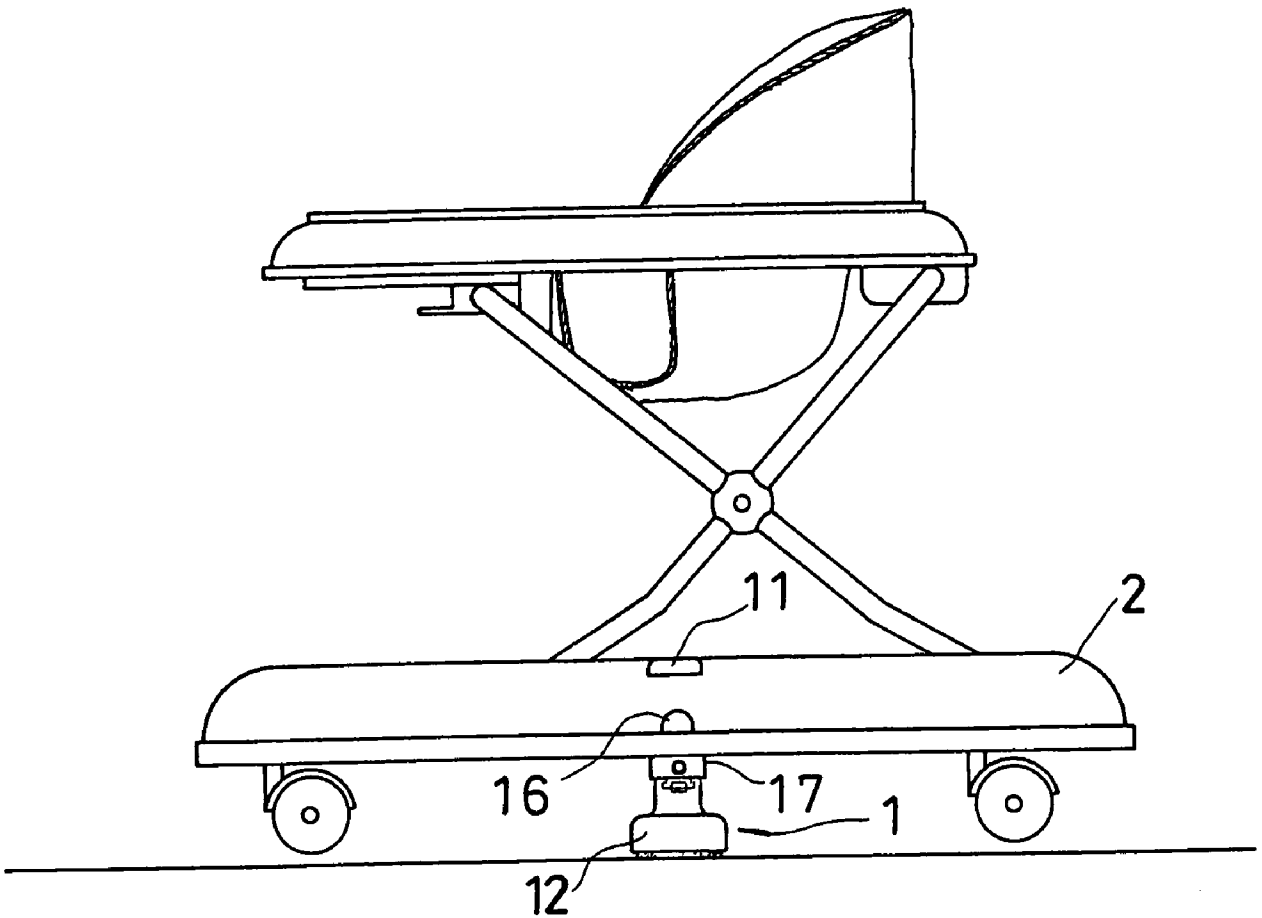
FIG. 9 is a side view of the baby-walker, with the immobilizing mechanism in the lower immobilizing position.
Figure 11:
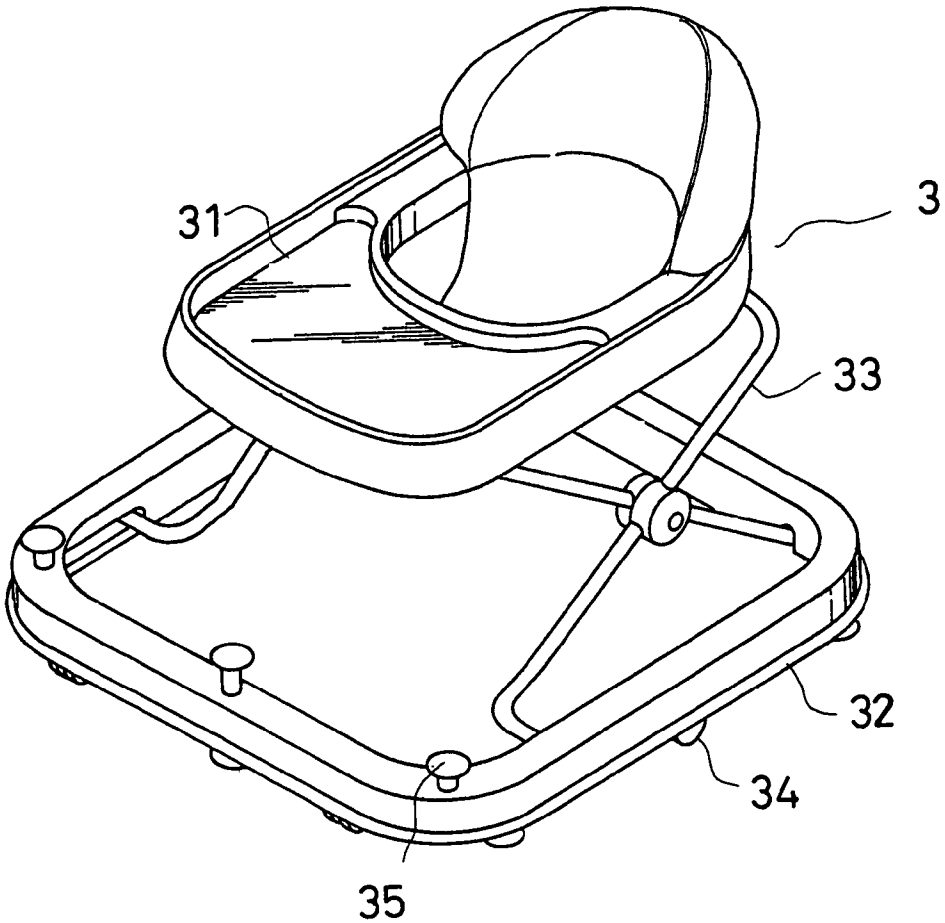
FIG. 11 (PRIOR ART)
FIG. 11 is perspective view of the conventional baby-walker.
Figure 12:
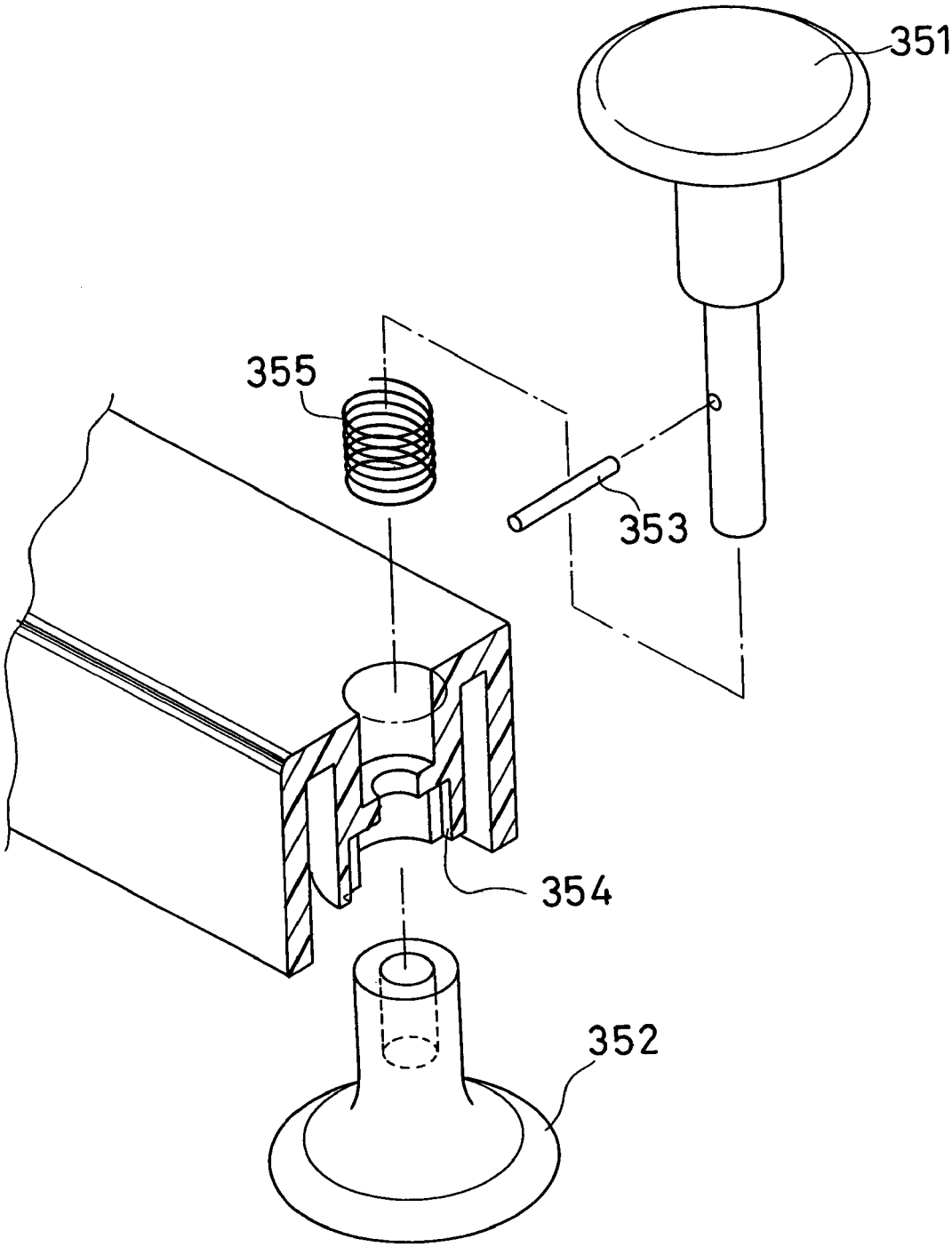
F I G. 12 (PRIOR ART)
FIG. 12 is an exploded perspective view of the conventional immobilizing mechanism as described in Background.
Figure 14:
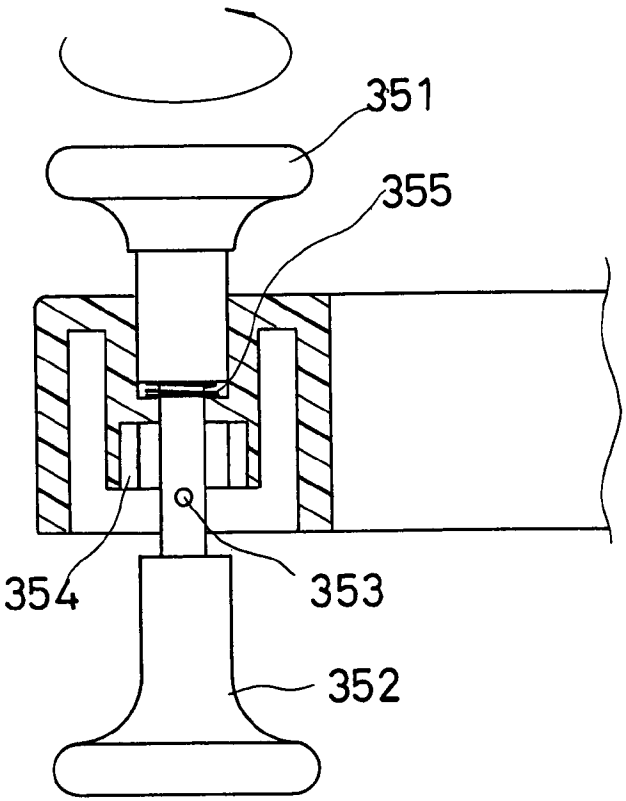
FIG. 14 (PRIOR ART)
FIG. 14 is a vertical section of the conventional immobilizing mechanism, in the lower immobilizing position.
Figure 13:
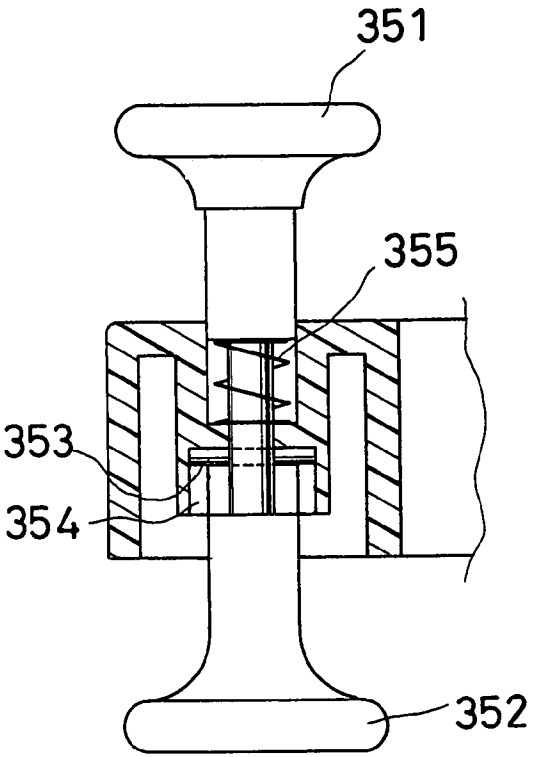
FIG. 13 (PRIOR ART)
FIG. 13 is a vertical section of the conventional mechanism.

Referring to FIGS. 8 and 9, when the upper rod part 11 is depressed to cause downward movement of the base part 12 together with it, the immobilizing mechanism 1 will be in an immobilizing position where both the upper rod part 11 and the base part 12 are in their respective lower positions, and where the resilient engaging portion 115 will automatically snap into the locating recess 23 to engage the lower frame part 2, and face the button 16, and the slide-prevention pad 124 will contact the ground, as shown in FIG. 9. Thus, the upper rod part 11 is stopped from moving back to the upper position by means of the engagement between the resilient engaging portion 115 and the lower frame part 2. Consequently, the baby-walker is supported on the present immobilizing mechanism 1, and becomes immobile with the wheels thereof being off the ground.

When the button 16 is pushed so as to make the resilient engaging portion 115 of the upper rod part 11 move outside the locating recess 23, the resilient engaging portion 115 will disengage the lower frame part 2, and both the upper rod part 11 and the base part 12 are made to move back to their respective upper positions by the springs 15. Thus, the slide prevention pad 124 of the base part 12 is away from the ground, and the baby-walker becomes mobile on the wheels thereof again.

From the above description, it can be easily understood that the immobilizing mechanism of a baby-walker of the present invention has the following advantages as compared with the conventional one:

1. There are springs 15, and 13 provided respectively for biasing the upper rod part 11 upwards, and for biasing both the base part 12 and the connecting tube 17 downwards.
2. Because of the spring 13, a lower end of the base part 12 is normally farthest away from the upper rod part 11. Therefore, to make the present mechanism function, the user only has to depress the upper rod part 11, needing not to lift the baby-walker, and the present mechanism is convenient to use.
3. The present mechanism will become inactive as soon as the button 16 is pressed. Therefore, the present mechanism is convenient to use.

What is claimed is:

1. An immobilizing mechanism of a baby-walker, comprising an upper rod part up and down movably held in a holding room of a lower frame part of a baby-walker; the upper rod part having a central room, and a down directed post in the central room; the upper rod part having two opposing through holes on a lower end thereof, and a plurality of locating protrusions on an outer side; the upper rod part having gaps formed on an upright side thereof such that there is a resilient engaging portion between the gaps; the resilient engaging portion being made to normally project outwards from the upright side of the upper rod part at an upper portion thereof; the lower frame part having both a locating recess adjacent to the holding room thereof, and a through hole communicating with the locating recess as well as outside;

a connecting tube movably held in a lower end of the central room of the upper rod, and connected with the upper rod part in an up and down displaceable manner by means of a connecting pin, which is passed through two opposing slots of the tube as well as the opposing through holes of the upper rod part; the connecting tube having a fitting portion on a bottom thereof; the bottom fitting portion being formed with a resilient engaging plate on a lower portion thereof; the resilient engaging plate having an engaging hook formed on a lower side thereof;

a base part joined to a lower end of the connecting tube with a top fitting trench thereof being fitted onto the bottom fitting portion of the connecting tube, with the engaging hook of the connecting tube being engaged with an engaging cavity thereon, and with a lower portion thereof projecting out from a lower end of the holding room of the lower frame part;

a button movably passed through the through hole of the lower frame part with an outer end thereof projecting out from the lower frame part;

a first spring positioned around the post of the upper rod part at an upper end, and on the connecting tube at a lower end thereof for making the connecting tube contact the connecting pin at upper ends of the slots thereof; and a plurality of second springs connected with respective ones of the locating protrusions of the upper rod part as well as the lower frame part for biasing the upper rod part to an upper position;

when the upper rod part is in the upper position, the base part being a distance above a ground where the baby-walker is supported;

when both the upper rod part and the base part are in respective lower positions, the upper rod part being capable of engaging the lower frame part as well as being secured in position with the resilient engaging portion thereof being held in, and engaged with the locating recess as well as facing the button; the base part being capable of contacting the ground at the lower end thereof when it is in said lower position, thus supporting the baby-walker thereon, and making the baby-walker immobile with wheels being off the ground;

the upper rod part being capable of disengaging the lower frame part when the button is pushed so as to make the resilient engaging portion of the upper rod part move outside the locating recess.

2. The immobilizing mechanism as claimed in claim 1, wherein both the top fitting trench of the base part and the fitting portion of the connecting tube have an inverted T-shape.

3. The immobilizing mechanism as claimed in claim 2, wherein the base part has a cut under, and communicating with an open end of the fitting trench thereof.

4. The immobilizing mechanism as claimed in claim 1, wherein the base part has a cut under, and communicating with an open end of the fitting trench thereof.

5. The immobilizing mechanism as claimed in claim 1, wherein the connecting tube has a plurality of upright plates therein for supporting the first spring on.

* * * * *